US006038735A

United States Patent [19]

Chang

[11] Patent Number: 6,038,735

[45] Date of Patent: Mar. 21, 2000

[54] HANDLE FOR A COMPACT TOOL

[76] Inventor: Chung-Min Chang, No. 18, Chilung Rd., Tali City, Taichung Hsien, Taiwan

[21] Appl. No.: 09/032,788

[22] Filed: Mar. 2, 1998

[51] Int. Cl.[7] ..... B25B 7/22

[52] U.S. Cl. ..... 16/110.1; 7/128; 30/153; 81/427.5

[58] Field of Search ..... 81/421, 423, 424, 81/427.5; 16/110.1; 7/128; 30/153, 255

[56] References Cited

U.S. PATENT DOCUMENTS

| | | | |
|---|---|---|---|
| 0,571,021 | 11/1896 | Schatz | 81/427.5 |
| 4,744,272 | 5/1988 | Leatherman | 81/427.5 |
| 5,745,997 | 5/1998 | Berg et al. | 81/427.5 |
| 5,791,002 | 8/1998 | Gardiner | 81/427.5 |
| 5,809,599 | 9/1998 | Frazer | 81/427.5 |

*Primary Examiner*—Chuck Y. Mah
*Assistant Examiner*—Donald M. Gurley
*Attorney, Agent, or Firm*—Rosenberg, Klein & Lee

[57] ABSTRACT

A handle for a compact tool which includes two handles and each of the handles has a tool member pivotally connected thereto. Each handle includes a connecting plate from which an operation end longitudinally extends, and two side walls bent downwardly from two respective opposite sides thereof. Each of the side walls has an engaging end extending longitudinally beyond the operation end and a tool member is pivotally connected between the two engaging ends. Two recesses are defined respectively between each of the engaging end and the operation end.

1 Claim, 4 Drawing Sheets

HANDLE FOR A COMPACT TOOL

BACKGROUND OF THE INVENTION

1. Field of the Invention

The present invention relates to a handle and, more particularly, to an improved handle for a foldable compact tool. The handle includes two side walls and a connecting plate integrally extending between the two side walls. Two recesses are defined between the connecting plate and the two side walls so that the two side walls are bent downwardly with respect to the connecting plate without causing a large stress concentration.

2. Brief Description of the Prior Art

FIGS. 4 and 5 show an example of a compact tool which includes a pair of handles 50 and jaw members 60 which are respectively pivotally connected to the two handles 50. The handles 50 each involve a connecting plate 501 and two side walls 51 respectively bent downwardly from two opposite sides of the connecting plate 501. The connecting plate 501 has an operation end 500 which is narrow compared with a width of the connecting plate 501 and each of the side walls 51 has an engaging end 52 which is bent downwardly from the operation end 500 and extends longitudinally beyond the operation end 500. The two engaging ends 52 each have a hole 53 defined therethrough so as to pivotally connect a respective one of the jaw members 60 between the two engaging ends 52 by a pivot 63. The two handles 50 can be folded about the two pivots 63 respectively to receive the two jaw members 60 therebetween. Each of the jaw members 60 has a limit protrusion 62 extending therefrom so as to contact against the corresponding operation end 500 of the handle 50 when in use. Typically, the handle 50 is manufactured by pressing a metal plate to form the connecting plate 501 and two side walls 51. However, because the width of the operation end is narrower than that of the connecting plate 501, a bent portion 55 is formed between the connecting plate 501 and either one of the side walls 51 is deformed severely so that a stress concentration is usually found in the bent portion 55. Such stress concentration increases a rate of defective products when pressing metal plates into to handles 50.

The present invention intends to provide an improved handle for a compact tool and there are two recesses respectively defined between the connecting plate and the two side walls so as to reduce a phenomenon of such a stress concentration.

SUMMARY OF THE INVENTION

The present invention provides a handle for a compact tool and comprising a connecting plate and two side walls integrally extending from two respective opposite sides of the connecting plate which has an operation end extending longitudinally therefrom. Each of the side walls has an engaging end extending longitudinally beyond the operation end of the connecting plate, and two recesses are respectively defined between the operation end and the two engaging ends. A tool member is pivotally connected between the two engaging ends.

It is an object of the present invention to provide a handle of a compact tool, which avoids a severe stress concentration during manufacturing the handle.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
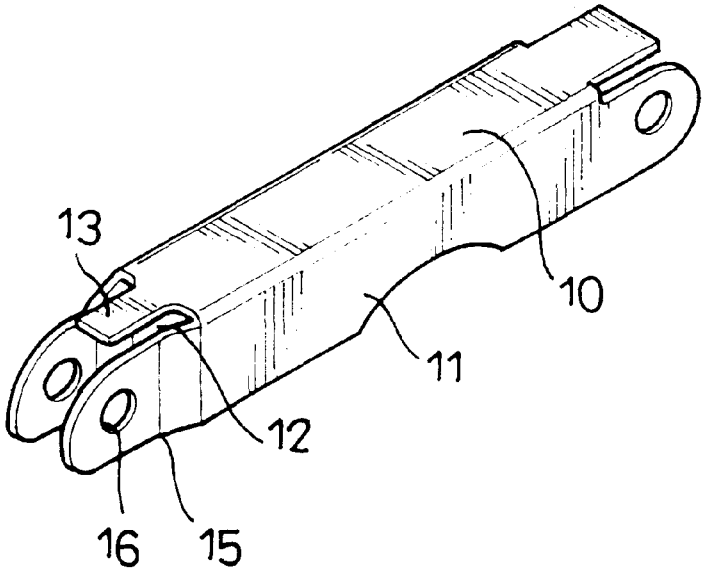
FIG. 1 is a perspective view of one of two handles in accordance with the present invention of a compact tool.
Figure 2:
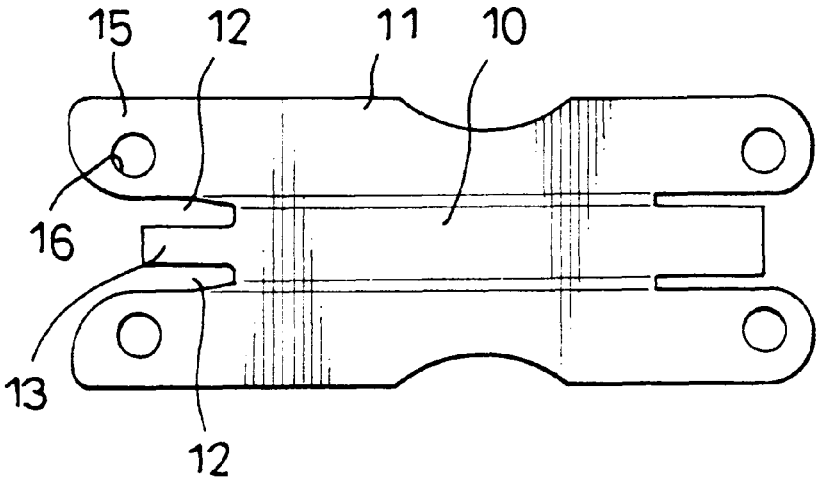
FIG. 2 is a plan view to illustrate a metal to be manufactured to form the handle of the present invention.

Referring to the drawings and initially to FIGS. 1 and 2, a handle in accordance with the present invention generally includes a connecting plate 10 and two side walls 11 integrally extending from two respective opposite sides of the connecting plate 10 which has an operation end 13 extending longitudinally therefrom. Each of the side walls 11 has an engaging end 15 extending longitudinally beyond the operation end 13 of the connecting plate 10. Two recesses 12 are respectively defined between the operation end 13 and the two engaging ends 15. The engaging ends 15 each have a hole 16 defined therethrough and are bent inwardly toward each other as shown in FIG. 1. At the opposing end 23, there are formed two recesses 22 between the end 23 and the corresponding ends 25 of the two side walls 11.

Figure 3:
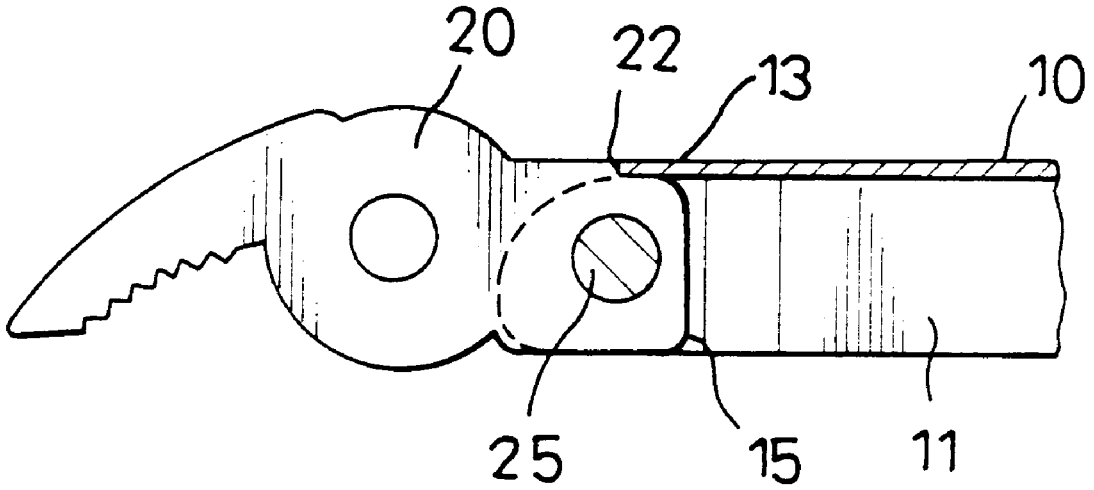
FIG. 3 is a side elevation view of a part of the compact tool to show a tool member pivotally connected to the handle of the present invention.
Figure 4:
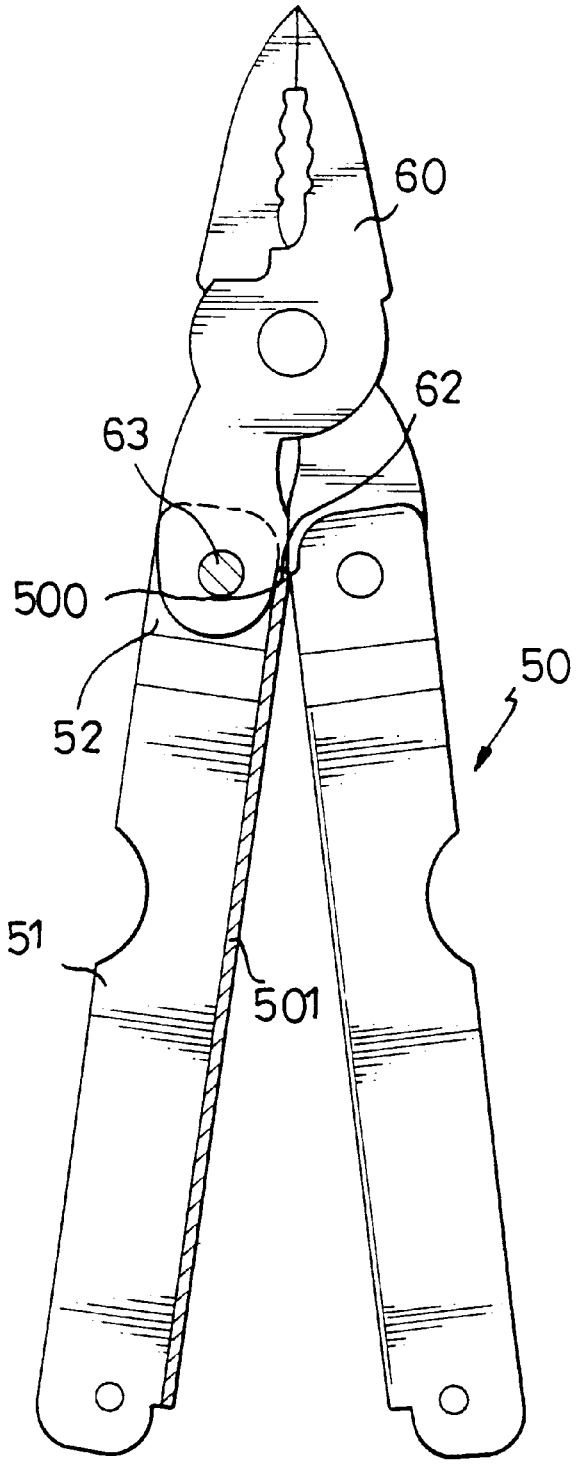
FIG. 4 PRIOR ART
FIG. 4 is a plan view to show a conventional compact tool.
Figure 5:
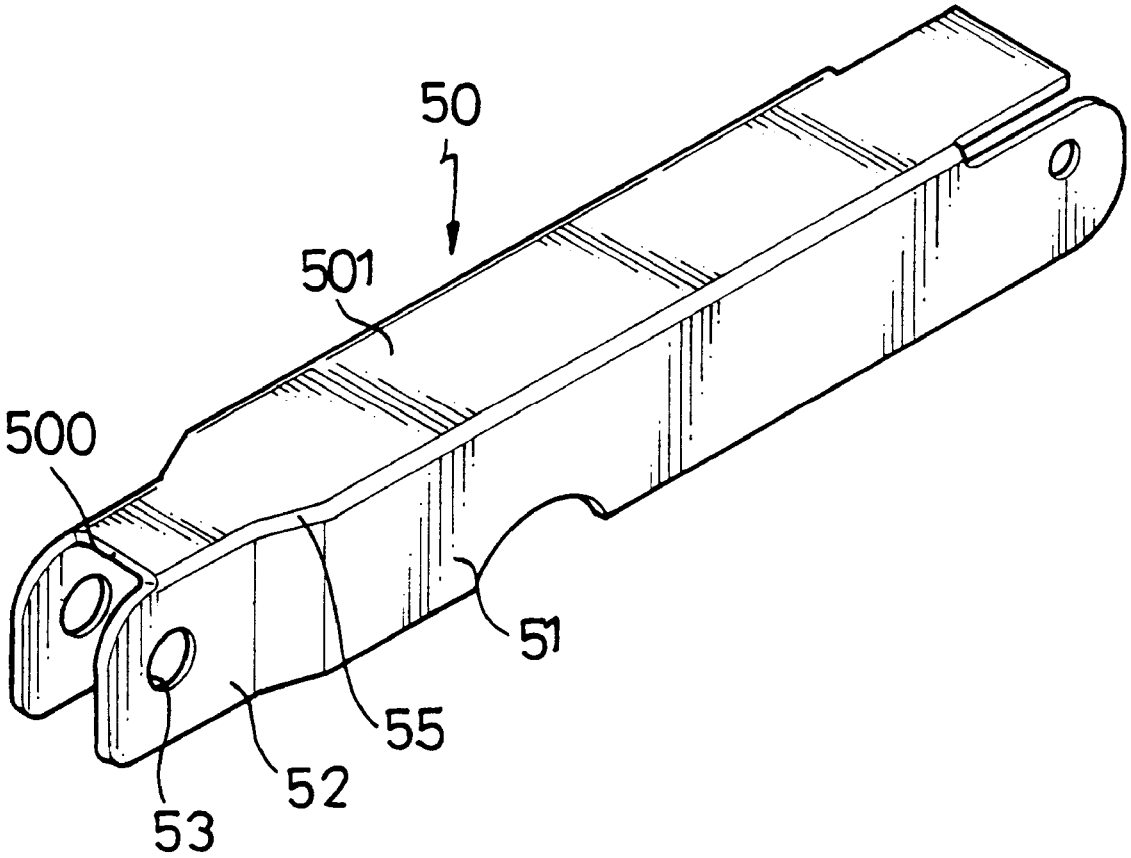
FIG. 5 PRIOR ART
FIG. 5 is a perspective view of one of two handles of the conventional compact tool shown in FIG. 4.

Referring to FIG. 3, a tool member such as a jaw member 20 is pivotally connected between the two engaging ends 15 of the handle by extending a pivot 25 through the jaw member 20 and the two holes 16 of the two engaging ends 15. The jaw member 20 has a limit protrusion 22 extending therefrom so as to contact against the operation end 13 when in use, which is well known in the art.

The two recesses 12 allow a bending action of the two side walls 11 with respect to the connecting plate 10 to have no stress concentration as happened in the conventional handle as described hereinabove.

Although the invention has been explained in relation to its preferred embodiment, it is to be understood that many other possible modifications and variations can be made without departing from the spirit and scope of the invention as hereinafter claimed.

What is claimed is:

1. A handle for a compact tool, comprising:

a connecting plate and two side walls integrally extending perpendicularly and in the same direction from two respective opposite sides of said connecting plate, said connecting plate having a first end extending longitudinally therefrom and an opposing second end, each of said side walls having an engaging end extending longitudinally beyond said first end of said connecting plate, a first pair of longitudinally extending recesses being respectively formed between said first end of said connecting plate and said two engaging ends, said two engaging ends being disposed at a distance one from another less than a width dimension of said connecting plate, a second pair of longitudinally extending recesses being respectively formed between said second end of said connecting plate and said side walls, a tool member being adapted to be pivotally connected between said two engaging ends.

* * * * *